US005876112A

United States Patent [19]

Wu

[11] Patent Number: 5,876,112

[45] Date of Patent: Mar. 2, 1999

[54] DECORATIVE LAMP ASSEMBLY

[76] Inventor: Gordon K.H. Wu, 5F, No. 5, Lane 338, Sec. 3,, Nang King E. Road, Taipei, Taiwan

[21] Appl. No.: 590,822

[22] Filed: Jan. 24, 1996

[51] Int. Cl.[6] ..... F21M 3/14; G09F 9/307

[52] U.S. Cl. ..... 362/255; 362/248; 362/806; 40/442; 428/11

[58] Field of Search ..... 362/227, 235–237, 362/248, 249, 251, 255, 256, 351, 806; 40/442, 444, 431, 541, 714, 716; 428/11; D26/2, 4–6

[56] References Cited

U.S. PATENT DOCUMENTS

| | | | |
|---|---|---|---|
| D. 83,153 | 1/1931 | Fabricant | D26/4 |
| D. 356,167 | 3/1995 | Bohannon | D26/4 |
| 1,632,850 | 6/1927 | Raymond | 362/255 |
| 1,777,550 | 10/1930 | Craig | 40/444 |
| 2,367,444 | 1/1945 | Stam | 362/256 |
| 3,462,632 | 8/1969 | Russi | 428/11 |
| 3,604,707 | 9/1971 | Hurley | 40/442 |
| 3,767,903 | 10/1973 | Dean, III | 362/251 |
| 4,300,068 | 11/1981 | Baird et al. | 362/351 |

*Primary Examiner*—Alan Cariaso
*Attorney, Agent, or Firm*—Bacon & Thomas

[57] ABSTRACT

A plurality of lamps electrically connected together have different decorative patterns on the surfaces of the lamp bulbs so that when the bulbs are sequentially lit, a story is progressively and visually displayed.

1 Claim, 2 Drawing Sheets

DECORATIVE LAMP ASSEMBLY

FIELD OF THE INVENTION

The present invention relates to a lamp and a lamp string made from a plurality of lamps and in particular to a lamp having a decorative pattern coated on the surface of the bulb.

BACKGROUND OF THE INVENTION

Lamps or lamp strings have been widely used to decorate trees, buildings and so on for celebrations or festivals. The lamps or lamp strings are sometimes used for advertisement purpose, for example to highlight an advertisement board.

Conventionally, the lamps are connected in series or parallel with electrical wires and the lamps and wires are fixed by means of, for example, threads to a tree or a building. The lamps are lit in a pre-determined sequence to provide the decoration or advertisement purpose and no visual decoration of the lamps themselves is provided. It is therefore desirable to provide a lamp having visual decoration effect and also a lamp string formed with such decorative lamps.

SUMMARY OF THE INVENTION

The principal object of the present invention is to provide a decorative lamp having a surface coating of a substantially light nontransmitting material provided on outer surface of a bulb of the lamp to define on the bulb surface a decorative pattern so that when the lamp is lit, a visual decoration is shown in correspondence to the decorative pattern of the bulb surface.

It is another object of the present invention to provide a lamp string comprising a number of the decorative lamps connected together to provide a more attractive decorative effect during the lighting of the lamp string.

It is a further object of the present invention to provide a lamp string comprising a number of the decorative lamps, wherein each of the decorative lamps has a different decorative pattern thereon so that when the lamp string is energized to light the lamps in a pre-determined sequence, a visual "story" or dynamic decoration is shown.

In accordance with the present invention, there is provided a decorative lamp having a decorative pattern coated on an outer surface of the bulb so that when the lamp is lit, a decorative vision corresponding to the coated pattern is shown. A number of the decorative lamps may be connected with an electrical wire to provide a festival lamp string.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
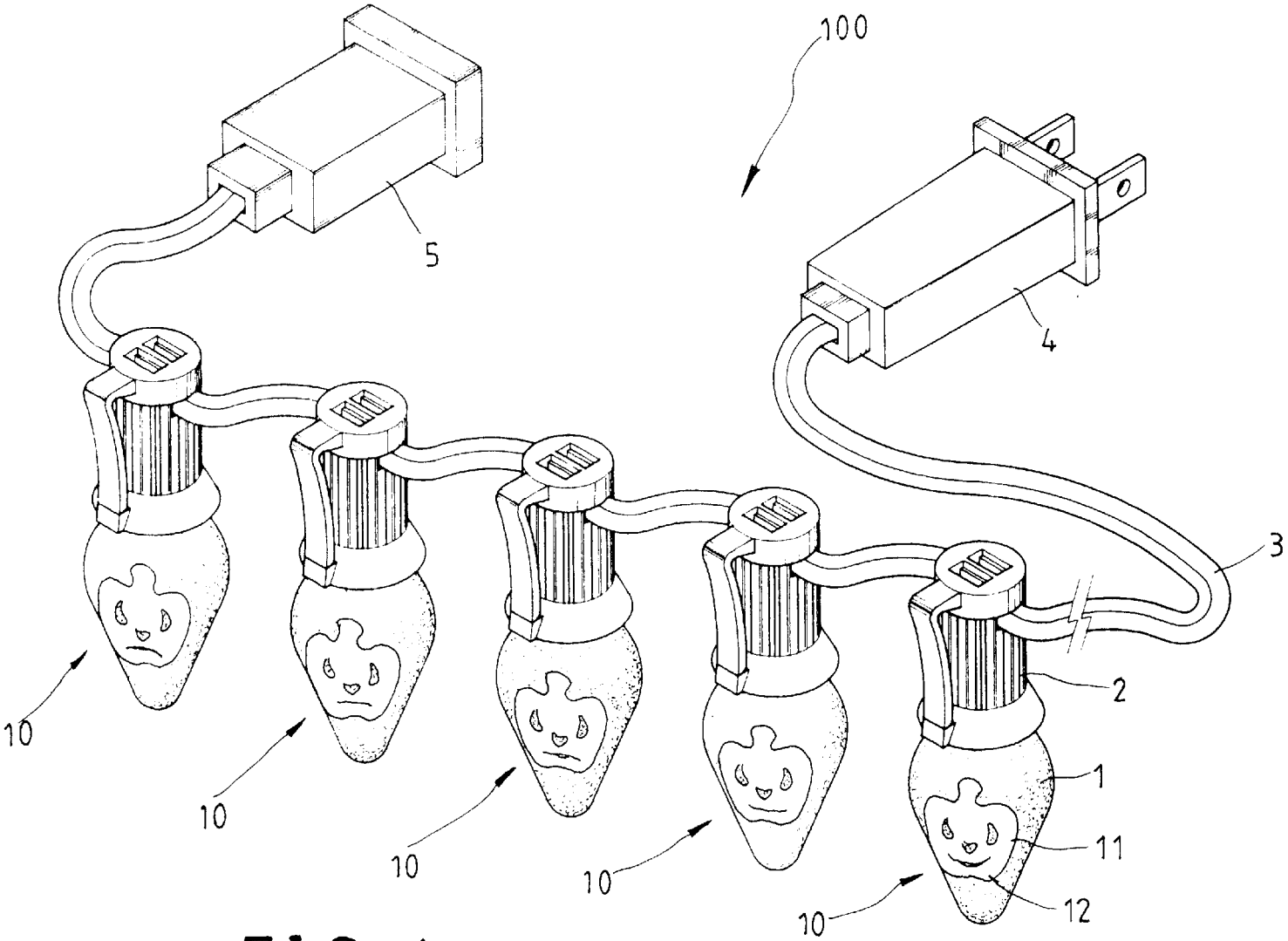
FIG. 1 is a perspective view showing a lamp string comprising a plurality of decorative lamps constructed in accordance with the present invention.
Figure 2:
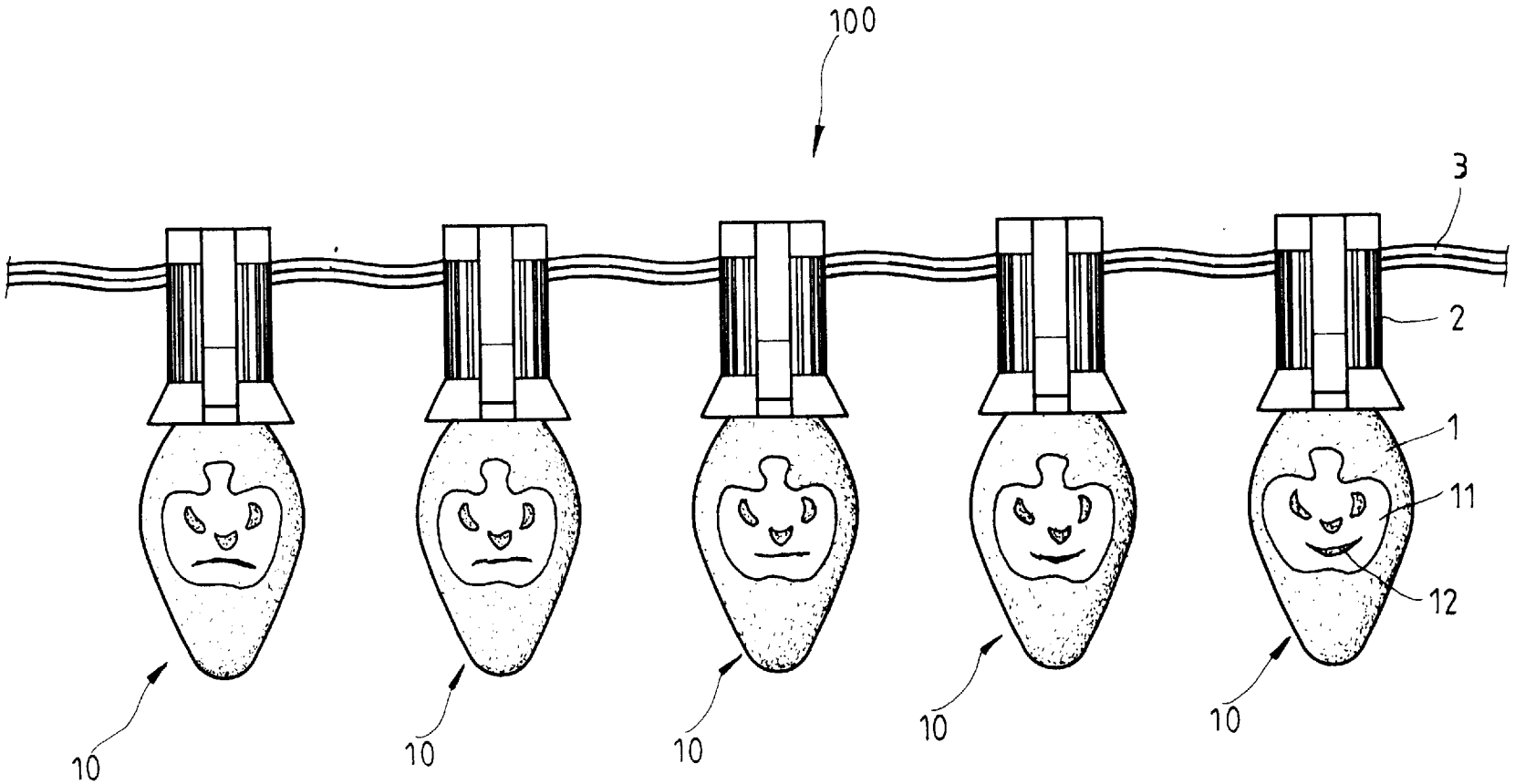
FIG. 2 is a side elevational view of the lamp string shown in FIG. 1.

With reference to FIGS. 1 and 2 of the drawings, wherein a lamp string, designated with the reference numeral 100, comprising a plurality of decorative lamps constructed in accordance with the present invention is shown, each of the decorative lamps, which are generally designated with the reference numeral 10, comprises a holder 2 to receive and retain therein a bulb 1. The bulb has an opaque or translucent surface coating, for example a light nontransmitting material or a dark, light absorbing material, provided thereon to form a decorative pattern which defines on the bulb surface at least a light transmitting area 11 which is formed by providing no such surface coating material on the area and a light nontransmitting area 12. By suitable design of the combination of the light transmitting area 11 and the light nontransmitting area 12, a decorative patterns is formed on the bulb surface. With the bulb 1 lit, a visual decoration corresponding to the decorative pattern becomes visible.

In the embodiment illustrated, the decorative pattern is a Halloween pumpkin face. It may of course be possible to provide other pattern on the bulb surface. For example, in the lamp string 100 that comprises a number of the decorative lamps 10, each of the lamps 10 is provided with a different pattern and these patterns constitute a "story" so that when the lamp string 100 is energized and the lamps 10 are lit in a pre-determined sequence, a "story" is progressively visually told. The bulbs 1 may also be coated with different patterns in such a manner that when the lamps 10 are lit in sequence, a dynamic decorative vision is provided, as shown in FIG. 2.

The lamp string 100 comprises an electrical wire 3 connected to and extending through the holders 2 of the lamps 10 to supply electricity to lamps 10. A plug 4 is provided on one end of the wire 3 for connection with a power source, such as a wall outlet (not shown). Preferably, an electrical socket 5 is provided on another end of the wire 3 for connection with the plug 4 of a similar lamp string.

Although a preferred embodiment has been described to illustrate the present invention, it is apparent that changes and modifications to the specifically described embodiment, such as change of the decorative pattern, can be carried out without departing from the scope of the invention which is intended to be limited only by the appended claims.

What is claimed is:

1. A decorative lamp assembly comprising a plurality of lamps electrically connected together including means for sequential illumination of said lamps in a predetermined manner, each lamp including a bulb having a surface provided with at least one light transmitting area and at least one light nontransmitting area, the transmitting and nontransmitting areas collectively defining a desired decorative pattern on the bulb surface, and the decorative patterns of the bulbs being different from each other for progressively and visually conveying a story when the bulbs are sequentially illuminated.

* * * * *